US005115792A

United States Patent [19]

Fukui

[11] Patent Number: 5,115,792

[45] Date of Patent: May 26, 1992

[54] IGNITION CONTROL APPARATUS AND METHOD FOR AN INTERNAL COMBUSTION ENGINE

[75] Inventor: Wataru Fukui, Himeji, Japan

[73] Assignee: Mitsubishi Denki K.K., Tokyo, Japan

[21] Appl. No.: 699,842

[22] Filed: May 14, 1991

[30] Foreign Application Priority Data

May 17, 1990 [JP] Japan ..... 2-125481

[51] Int. Cl.[5] ..... F02P 9/00

[52] U.S. Cl. ..... 123/613; 123/643; 364/431.07

[58] Field of Search ..... 123/613, 643, 414, 416, 123/417, 418, 620, 630, 636, 637; 364/431.07

[56] References Cited

U.S. PATENT DOCUMENTS

| | | | |
|---|---|---|---|
| Re. 31,709 | 10/1984 | Ford | 123/416 |
| 4,681,082 | 7/1987 | Onogi et al. | 123/643 |
| 4,711,227 | 12/1987 | Li et al. | 123/643 |
| 4,757,798 | 7/1988 | Sasaki | 123/643 |
| 4,870,587 | 9/1989 | Kumagai | 364/431.07 |
| 4,951,639 | 8/1990 | Iwata et al. | 123/613 |
| 4,961,410 | 10/1990 | Matsumura et al. | 123/643 |
| 4,979,485 | 12/1990 | Iwata et al. | 123/613 |
| 4,979,487 | 12/1990 | Fukui | 123/643 |
| 5,027,785 | 7/1991 | Deutsch | 123/643 |
| 5,038,743 | 8/1991 | Remmers | 123/613 |

*Primary Examiner*—Raymond A. Nelli
*Attorney, Agent, or Firm*—Sughrue, Mion, Zinn, Macpeak & Seas

[57] ABSTRACT

A signal generator generates a crank angle reference signal and a cylinder identification signal in synchronism with the rotation of a multi-cylinder internal combustion engine. The crank angle reference signal has high and low levels which change at a first reference crank position and at a second reference crank position of each cylinder. The cylinder identification signal corresponds to a specific cylinder and is out of phase with respect to the crank angle reference signal. The operating position of each cylinder is determined on the basis of the crank angle reference signal and the cylinder identification signal so that the ignition of each cylinder is controlled based on these signals. The ignition control for the cylinders is stopped if there is an abnormality in the crank angle reference signal or in the cylinder identification signal. This improves reliability and stability in the control of the overall system.

5 Claims, 4 Drawing Sheets

B75° : FIRST REFERENCE POSITION

B5° : SECOND REFERENCE POSITION

IGNITION CONTROL APPARATUS AND METHOD FOR AN INTERNAL COMBUSTION ENGINE

BACKGROUND OF THE INVENTION

The present invention relates to an apparatus and a method for controlling the ignition of an internal combustion engine based on a crank angle reference signal and a cylinder identification signal generated by a signal generator. More particularly, it relates to an ignition control apparatus and method in which misidentification of cylinders due to noise, or breaks in wiring or short-circuiting of the signal generator can be prevented to improve ignition control reliability.

In order for a multi-cylinder internal combustion engine such as used in automobiles to properly operate, fuel injection, ignition and the like for each cylinder must take place at prescribed rotational positions or angles of the crankshaft of the engine, i.e., at times when each piston of the engine is at a prescribed position with respect to top dead center. For this reason, an engine is equipped with a rotational position sensor such as a signal generator which senses the rotational angle or position of the crankshaft of the engine.

FIG. 3 illustrates, in a block diagram, a conventional control apparatus for a multi-cylinder internal combustion engine. The engine control apparatus includes a signal generator 8 which generates a positional signal L including a plurality of positional pulses corresponding to the respective cylinders of the engine, an interface circuit 9, and a control unit 10 in the form of a microcomputer which receives the positional signal L from the signal generator 8 through the interface circuit 9 and recognizes, based thereon, the operating condition (i.e., crank angle or rotational position) of each cylinder.

A typical example of such a signal generator 8 is illustrated in FIG. 4. In this figure, the signal generator 8 illustrated includes a rotating plate 2 mounted on a rotating shaft 1 (such as the distributor shaft) which rotates in synchrony with the crankshaft of the engine. The rotating plate 2 has a set of first slits 3*a* formed in it at prescribed locations. The slits 3*a* are disposed at equal intervals in the circumferential direction of the rotating plate 2. The slits 3*a*, which are equal in number to the cylinders, are disposed so as to correspond to prescribed rotational angles of the crankshaft and thus to prescribed positions of each piston with respect to top dead center for sensing when the crankshaft reaches a prescribed rotational position for each cylinder. Another or second slit 3*b* is formed in the rotating plate 2 adjacent one of the first slits 3*a* at a location radially inwardly thereof for sensing when the crankshaft rotational angle is such that the piston of a specific reference cylinder is in a prescribed position.

A first and a second light emitting diode 4*a*, 4*b* are disposed on one side of the rotating plate 2 on a first outer circle and a second inner circle, respectively, on which the outer slits 3*a* and the inner slits 3*b* are respectively disposed. A first and a second light sensor 5*a*, 5*b* each in the form of a photodiode are disposed on the other side of the rotating plate 2 in alignment with the first and the second light emitting diode 4*a*, 4*b*, respectively. The first light sensor 5*a* generates an output signal each time one of the outer slits 3*a* passes between the first light sensor 5*a* and the first light emitting diode 4*a*. Also, the second light sensor 5*b* generates an output signal each time the inner slit 3*b* passes between the second light sensor 5*b* and the second light emitting diode 4*b*. As shown in FIG. 5, the outputs of the first and second light sensors 5*a*, 5*b* are input to the input terminals of corresponding amplifiers 6*a*, 6*b* each of which has the output terminal coupled to the base of a corresponding output transistor 7*a* or 7*b* which has the open collector coupled to the interface circuit 9 (FIG. 3) and the emitter grounded.

Now, the operation of the above-described conventional engine control apparatus as illustrated in FIGS. 4 through 6 will be described in detail with particular reference to FIG. 6 which illustrates the waveforms of the output signals of the first and second light sensors 5*a*, 5*b*.

As the engine is operated to run, the rotating shaft 1 operatively connected with the crankshaft (not shown) is rotated together with the rotating plate 2 fixedly mounted thereon so that the first and second light sensors 5*a*, 5*b* of the signal generator 8 generate a first and a second signal $L_1$, $L_2$ each in the form of a square pulse. The first signal $L_1$ is a crank angle signal called an SGT signal and has a rising edge corresponding to the leading edge of one of the outer slits 3*a* (i.e., a first prescribed crank angle or position of a corresponding piston) and a falling edge corresponding to the trailing edge thereof (i.e., a second prescribed crank angle of the corresponding piston). In the illustrated example, each square pulse of the SGT signal $L_1$ rises at a crank angle of 75 degrees before top dead center (a first reference position B75) of each piston, and falls at a crank angle of 5 degrees before top dead center (a second reference position B5).

The second signal $L_2$ is a cylinder recognition signal called an SGC signal, and has a rising edge corresponding to the leading edge of the inner slit 3*b* and a falling edge corresponding to the trailing edge thereof. The SGC signal $L_2$ is issued substantially simultaneously with the issuance of an SGT signal pulse corresponding to the specific reference cylinder #1 so as to identify the same. To this end, the inner slit 3*b* is designed such that it has a leading edge corresponding to a crank angle before the first reference angle of the corresponding SGT signal pulse (i.e., a crank angle greater than 75 degrees before TDC), and a trailing edge corresponding to a crank angle after the second reference angle of the corresponding SGT signal pulse (i.e., a crank angle smaller than 5 degrees before TDC). Thus, actually, the rising edge of an SGC signal pulse occurs before that of a corresponding SGT signal pulse, and the falling edge of the SGC signal pulse occurs after that of the corresponding SGT signal pulse.

The two kinds of first and second signals $L_1$, $L_2$ thus obtained are input via the interface circuit 9 to the microcomputer 10 which identifies the specific reference cylinder #1 based on the second signal $L_2$, and the operational positions (i.e., crank angles or rotational positions) of the remaining cylinders #2 through #4 based on the first signal $L_1$, whereby various operational calculations and engine control operations such as for controlling ignition timing, fuel injection timing, etc., are properly performed. For example, the power supply to an unillustrated ignition coil is started by a timer after the lapse of a first predetermined time from the rising edge of a pulse of the first signal $L_1$ (i.e., the reference position of 75 degrees before top dead center), and then it is cut off after the lapse of a second predetermined time therefrom.

Specifically, cylinder identification can be performed based on the level of the cylinder identification signal $L_2$ at the rising edge of each pulse of the crank angle reference signal $L_1$. That is, if the cylinder identification signal $L_2$ at the rising edge of a pulse of the crank angle reference signal $L_1$ is high, it is determined that the pulse corresponds to cylinder #1 or #4. If, however, it is low, the pulse is determined to correspond to cylinder #2 or #3.

In the case of grouped ignition control, although cylinders #1 and #4 are concurrently fired for example, there will be no problems such as abnormal combustion, detonation and the like since when cylinder #1 is on the compression stroke, cylinder #4 is on the exhaust stroke. In this case, however, if at least one of the crank angle reference signal $L_1$ and the cylinder identification signal $L_2$ is held fixed at the low or high level due to a circuit failure such as a break in wiring, short-circuiting and the like in the signal generator 8, the microcomputer 10 is unable to discern the occurrence of such a failure, resulting in misidentification of the cylinders. As a result, the microcomputer 10 becomes unable to control the overall system in a stable manner, which might lead to further trouble. The same problems will arise when noise is superposed on the pulses of the positional signal L.

With the conventional ignition control apparatus and method as described above, it is impossible to determine whether the positional signal L is normal or abnormal, so failure in the signal generator 8 and/or disturbances of the signal generator outputs due to noise causes misidentification of the cylinders, thus giving rise to erroneous or improper ignition. This often results in damage to the engine.

SUMMARY OF THE INVENTION

The present invention is intended to overcome the above-described problems encountered with the conventional ignition control apparatus and method.

An object of the present invention is to provide a novel and improved ignition control apparatus and method for an internal combustion engine in which when it is determined that there is an abnormality in the positional signal, ignition control is stopped or skipped, thereby improving reliability and stability in the control of the overall system.

In order to achieve the above object, according to one aspect of the invention, there is provided an ignition control apparatus for a multi-cylinder internal combustion engine comprising:

a signal generator generating a crank angle reference signal and a cylinder identification signal in synchronism with the rotation of the engine, the crank angle reference signal having high and low levels which change at a first reference crank position and at a second reference crank position for each cylinder of the engine, the cylinder identification signal corresponding to a specific cylinder and being out of phase with respect to the crank angle reference signal; and a controller for identifying the operating position of each cylinder on the basis of the crank angle reference signal and the cylinder identification signal, the controller controlling the ignition of each cylinder on the basis of the crank angle reference signal and the cylinder identification signal, the controller including an ignition inhibiter for stopping the ignition control for the cylinders if there is an abnormality in at least one of the crank angle reference signal and the cylinder identification signal.

According to another aspect of the invention, there is provided an ignition control method for a multi-cylinder internal combustion engine comprising the steps of:

generating a crank angle reference signal having high and low levels which change at a first reference crank position and at a second reference crank position of each cylinder of the engine;

generating a cylinder identification signal corresponding to a specific cylinder, the cylinder identification signal being out of phase with respect to the crank angle reference signal;

identifying the operating position of each cylinder on the basis of the crank angle reference signal and the cylinder identification signal;

controlling the ignition of each cylinder on the basis of the crank angle reference signal and the cylinder identification signal; and stopping the ignition control for the cylinders if there is an abnormality in at least one of the crank angle reference signal and the cylinder identification signal.

According to a further aspect of the invention, there is provided an ignition control method for an internal combustion engine comprising the steps of:

a first step of generating a crank angle reference signal and a cylinder identification signal, the crank angle reference signal having high and low levels which change at a first reference crank position and at a second reference crank position of each cylinder of the engine, the cylinder identification signal corresponding to a first group of cylinders of the engine, the cylinder identification signal being out of phase with respect to the crank angle reference signal;

a second step of detecting the level of the cylinder identification signal at the time when the level of the crank angle reference signal changes;

a third step of determining whether the detected level of the cylinder identification signal is high or low;

a fourth step of determining whether the value of a first counter for the first group of cylinders is equal to a first predetermined number, if the detected level of the cylinder identification signal is high;

a fifth step of performing ignition control for the first group of cylinders if the value of the first counter is equal to the first predetermined number;

a sixth step of skipping ignition control for the first group of cylinders if the first counter is not equal to the first predetermined value;

a seventh step of setting the first counter to a second predetermined value after the sixth or seventh step;

an eight step of changing the value of a second counter for the other second group of cylinders of the engine after the seventh step;

a ninth step of determining whether the value of the second counter is equal to the first predetermined number, if the detected level of the cylinder identification signal is low;

a tenth step of performing ignition control for the second group of cylinders if the value of the second counter is equal to the first predetermined number;

an eleventh step of skipping ignition control for the second group of cylinders if the second counter is not equal to the first predetermined value;

a twelfth step of setting the second counter to the second predetermined value after the eleventh step;

a thirteenth step of changing the value of the first counter after the twelfth step; and repeating all the above steps.

The above and other objects, features and advantages of the present invention will become more readily apparent from the ensuing detailed description of a preferred embodiment of the invention taken in conjunction with the accompanying drawings.

DESCRIPTION OF THE PREFERRED EMBODIMENT

A preferred embodiment of the present invention will now be described in detail while referring to the accompanying drawings.

Figure 1:
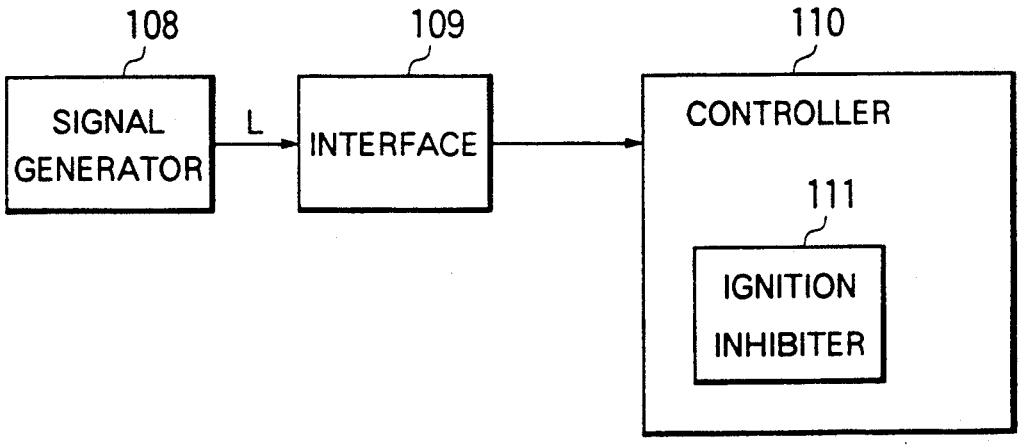
FIG. 1 is a schematic block diagram of an ignition control apparatus for an internal combustion engine according to the present invention.

Referring to the drawings and first to FIG. 1, there is schematically illustrated an ignition control apparatus for a multi-cylinder internal combustion engine in accordance with the invention. The apparatus of the invention includes a signal generator 108, an interface 109 and a controller 110 in the form of a microcomputer. The signal generator 108 and the interface 109 are the same as the elements 8, 9, respectively, of the aforementioned ignition control apparatus as illustrated in FIGS. 3 through 6. Thus, the signal generator 108 generates a positional signal L comprising a crank angle reference signal $L_1$ and a cylinder identification signal $L_2$ in synchronism with the rotation of the engine, the crank angle reference signal $L_1$ having high and low levels which change at a first reference crank position (e.g., 75 degrees BTDC) and at a second reference crank position (e.g., 5 degrees BTDC), the cylinder identification signal $L_2$ corresponding to a specific cylinder or a specific group of cylinders and being out of phase with respect to the crank angle reference signal $L_1$.

Figure 2:
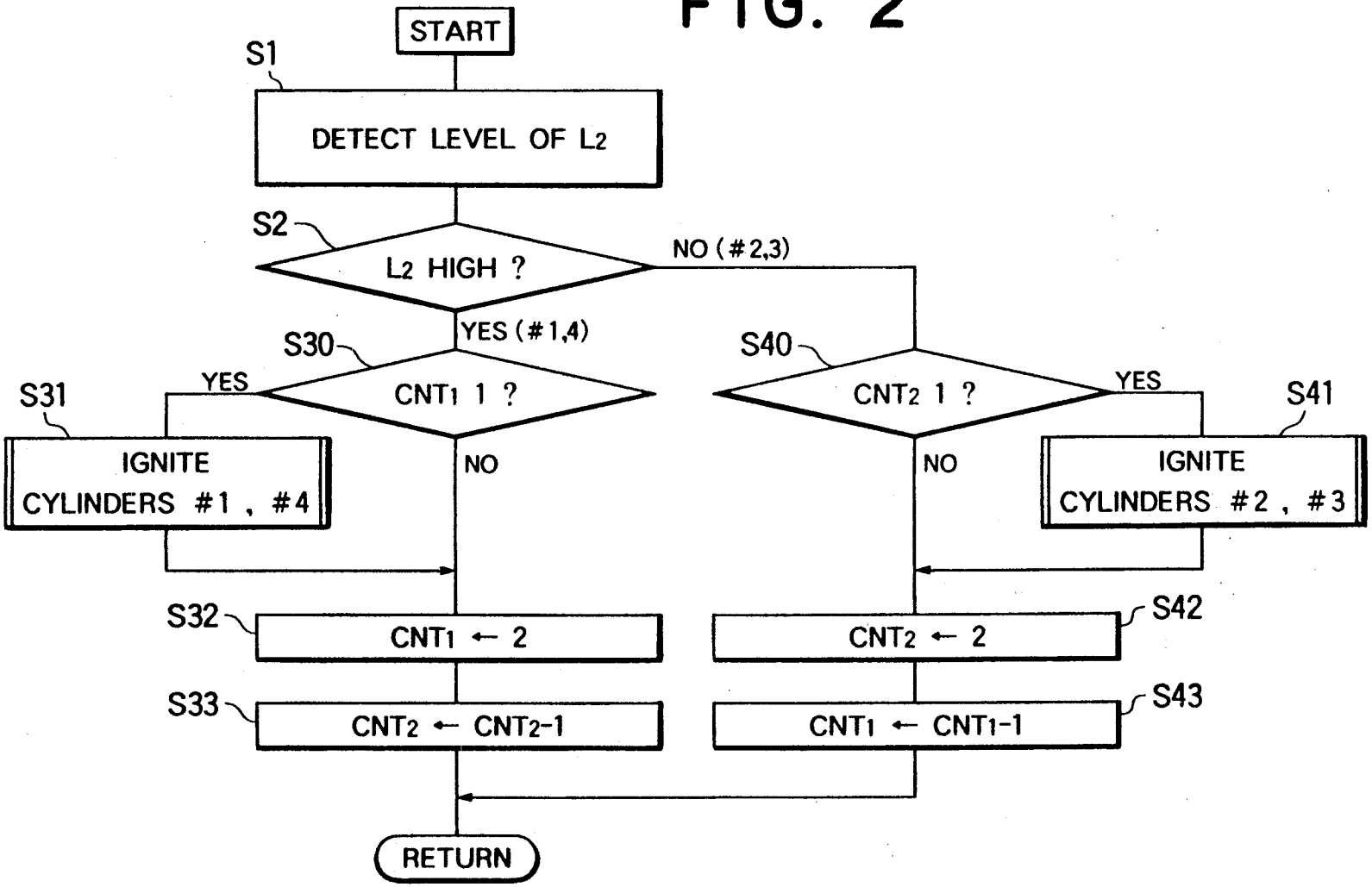
FIG. 2 is a flow chart explaining the operation of the ignition control apparatus of FIG. 1 as well as an ignition control method according to the present invention.
Figure 3:
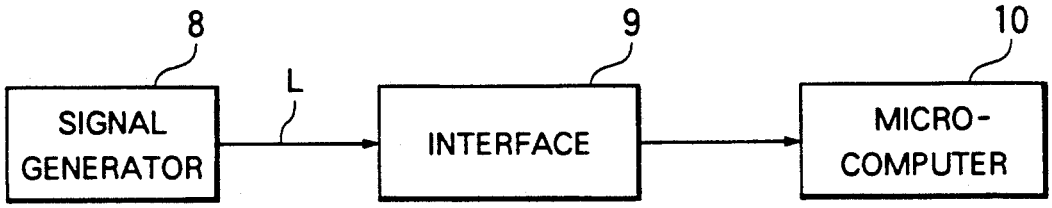
FIG. 3 is a schematic block diagram of a conventional engine control apparatus.
Figure 4:
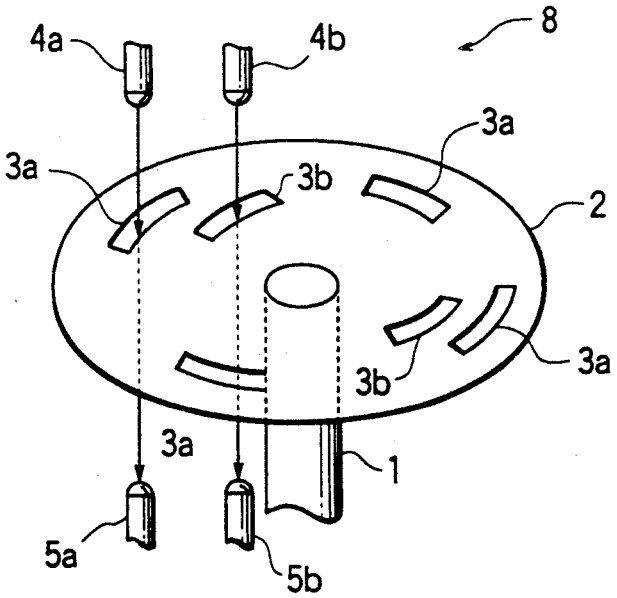
FIG. 4 is a perspective view illustrating the general arrangement of a conventional signal generator employed by the engine control apparatus of FIG. 3.
Figure 5:
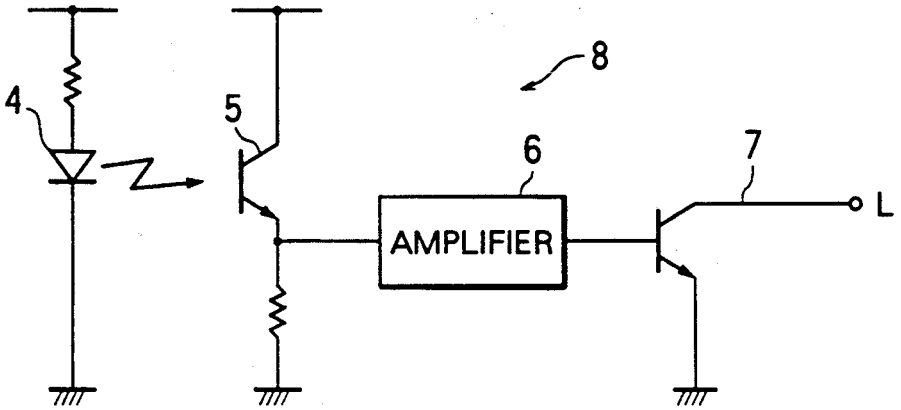
FIG. 5 is a schematic circuit diagram of the conventional signal generator of FIG. 4.
Figure 6:
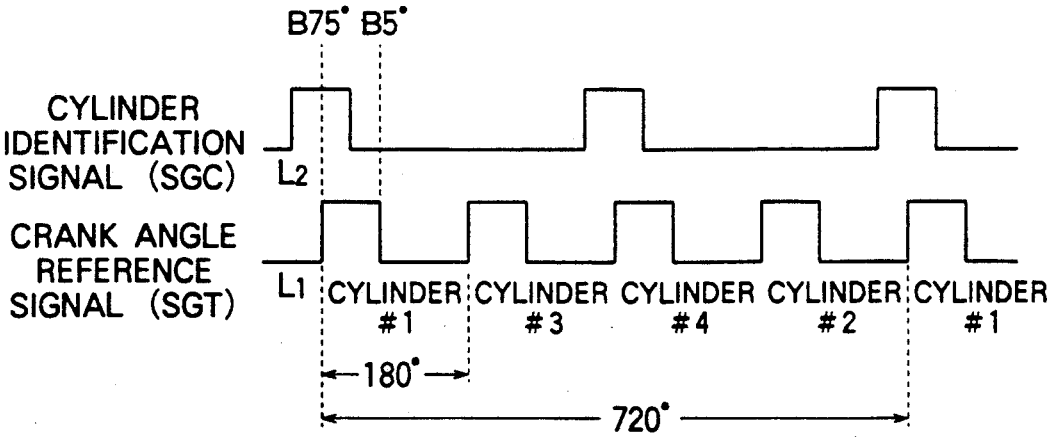
FIG. 6 is a waveform diagram showing the waveforms of the output signals of the conventional signal generator of FIG. 4.

The controller 110 is substantially similar to the microcomputer 10 of FIG. 3 except for the provision of an ignition inhibiter 111. The controller 110 identifies the operating position of each cylinder on the basis of the crank angle reference signal $L_1$ and the cylinder identification signal $L_2$, and it controls the ignition of each cylinder based on these signals. Specifically, based on the positional signal L from the signal generator 108, the controller 110 controls an unillustrated ignition means which, for example, includes two ignition coils, a first one of which is used for a first group of cylinders #1, #4, and the other or a second one for a second group of cylinders #2, #3. The ignition inhibiter 111 operates to stop the ignition control for the cylinders if there is an abnormality in at least one of the crank angle reference signal and the cylinder identification signal. To this end, the ignition inhibiter 111 includes a first counter CNT1 and a second counter CNT2 which are initially set to zero. Using the counters, the controller 110 executes a control program as shown in FIG. 2 for controlling the ignition of each cylinder.

The operation of this embodiment will now be described in detail with reference to FIG. 2. First, in Step S1, the controller 110 detects the level of the cylinder identification signal $L_2$ at the rising edge of a pulse of the crank angle reference signal $L_1$. Then, in Step S2, it is determined whether the cylinder identification signal $L_2$ is at a high or a low level. If it is high, it is determined that the crank angle reference signal pulse corresponds to cylinder #1 or #4, and then the program goes to S30. If it is low, however, the crank angle reference signal pulse is determined to correspond to cylinder #2 or #3, and the program goes to Step S40.

In Step S30, it is further determined whether the value of the first counter CNT1 for controlling the first ignition coil is a first predetermined number which is "1" in the illustrated example. If the answer is "YES", the program goes to Step S31 where the controller 110 performs ignition control for cylinders #1 and #4. If the answer is "NO", however, the program goes to Step S32 while skipping Step S31, i.e., stopping ignition control for cylinders #1, #4. In this regard, at an initial period, the value of the first counter CNT1 is "0", so the first counter CNT1 is set to a second predetermined value which is "2" in the illustrated example. Then, in Step S33, the second counter CNT2 for controlling the second ignition coil is decremented by 1. In this connection, since the first and second counters CNT1, CNT2 are clipped at zero, the second counter CNT2, if it is zero, remains unchanged. Thereafter, a return is performed.

In the following second processing cycle, if it is determined in Step S2 that the level of the cylinder identification signal $L_2$ is low, the program goes to Step S40 where it is determined whether the value of the second counter CNT2 for controlling the second ignition coil is the first predetermined number "1". If the answer is "YES", the program goes to Step S41 where the controller 110 performs ignition control for cylinders #2 and #3. If the answer is "NO", however, the program goes to Step S42 while skipping Step S41, i.e., without performing ignition control for cylinders, #2, #3. In this regard, since in an initial period, the value of the second counter CNT2 is zero, Step S41 is skipped and the program directly goes from Step S40 to Step S42. In Step S42, the second counter CNT2 is set to the second predetermined number "2", and then in Step S43, the first counter CNT1 is decremented by 1. In this case, the first counter CNT1, having been set to "2" in Step S32 in the preceding processing cycle, is changed into "1". Thereafter, a return is performed.

Accordingly, in the following third processing cycle, if it is determined in Step S2 that the level of the cylinder identification signal $L_2$ is high, the value of the first counter CNT1 is determined to be "1" in Step S30. As a result, it is determined that the positional signal L (i.e., both of the crank angle reference signal $L_1$ and the cylinder identification signal $L_2$) is normal. Thus, in Step S31, cylinders #1, #4 are fired. Then in Step S32, the first counter CNT1 is again set to the second predetermined number "2", and in Step S33, the second counter CNT2 is decremented by 1. At this time, the second counter CNT2, having been set to "2" in Step S42 in the preceding processing cycle, is changed into "1" in Step S33. After this, a return is carried out.

Thus, in the following fourth processing cycle, if it is determined in Step S2 that the level of the cylinder identification signal $L_2$ is low, the number of the second counter CNT2 is determined to be "1" in Step S40. As a result, it is determined that the positional signal L is normal so that the controller 110 fires cylinders #2, #3. Then, in Step S42, the second counter CNT2 is again set to the second predetermined number "2", and in Step S33, the first counter CNT1 is decremented by 1. Then, the program returns to Step S1.

Thereafter, the controller 110 performs ignition control at Steps S31, S41 in the same manner only if the positional signal L is determined to be normal. On the other hand, if it is determined that the positional signal L is abnormal (i.e., at least one of the crank angle reference signal $L_1$ and the cylinder identification signal $L_2$ is abnormal), the ignition control Steps S31 and S41 are skipped, and one of the first and second counter CNT1, CNT2 is set to the second predetermined number "2" in Step S32 or S42, and the other counter is changed or decremented by 1 in Step S33 or S43.

According to the above-described cylinder identification and ignition control routine, a plurality of groups of cylinders are successively identified in successive processing cycles so that a group of cylinders are first ignited or fired only if they are once again identified normally after all of the groups of cylinders have been identified normally. As a result, if the cylinder identification signal $L_2$ is continuously held fixed at the high or low level due to a break in wiring, short-circuiting, etc., of the signal generator 108, the level of the cylinder identification signal $L_2$ remains unchanged or fixed at the same level in every processing cycle so that a set of Steps S30, S32 and S33, or a set of Steps S40, S42 and S43 are repeatedly performed. That is, the first or second counter CNT1 or CNT2 is set to the second number "2" every time, so the ignition control Step S31 or S41 is always skipped. Accordingly, in the event that there is an abnormality in the positional signal L from the signal generator 108 due to its failure, noise and the like, ignition control is not carried out, thus preventing the engine from being damaged by improper firing which would otherwise result from the misidentification of the cylinders.

Although in the above embodiment, an example of grouped cylinders to be controlled is described, the present invention is of course applicable to the case in which a plurality of cylinders are individually identified and controlled, while providing the same results.

In addition, although in the above description, the first and second predetermined numbers are exemplarily selected to be "1" and "2", respectively, for the first and second counters CNT1 and CNT2 for the purpose of determining whether the positional signal L is normal or abnormal, and the first or second counter is decremented from the second number, the first and second numbers may be any appropriate numbers other than 1 and 2 based on which determination of the positional signal L can be carried out.

What is claimed is:

1. An ignition control apparatus for a multi-cylinder internal combustion engine comprising:

a signal generator generating a crank angle reference signal and a cylinder identification signal in synchronism with the rotation of the engine, the crank angle reference signal having high and low levels which change at a first reference crank position and at a second reference crank position for each cylinder of the engine, the cylinder identification signal corresponding to a specific cylinder and being out of phase with respect to the crank angle reference signal; and a controller for identifying the operating position of each cylinder on the basis of the crank angle reference signal and the cylinder identification signal, said controller controlling the ignition of each cylinder on the basis of the crank angle reference signal and the cylinder identification signal, said controller including an ignition inhibiter for stopping the ignition control for the cylinders if there is an abnormality in at least one of the crank angle reference signal and the cylinder identification signal.

2. An ignition control method for a multi-cylinder internal combustion engine comprising the steps of:

generating a crank angle reference signal having high and low levels which change at a first reference crank position and at a second reference crank position of each cylinder of the engine;

generating a cylinder identification signal corresponding to a specific cylinder, the cylinder identification signal being out of phase with respect to the crank angle reference signal;

identifying the operating position of each cylinder on the basis of the crank angle reference signal and the cylinder identification signal;

controlling the ignition of each cylinder on the basis of the crank angle reference signal and the cylinder identification signal; and stopping the ignition control for the cylinders if there is an abnormality in at least one of the crank angle reference signal and the cylinder identification signal.

3. An ignition control method for an internal combustion engine comprising the steps of:

a first step of generating a crank angle reference signal and a cylinder identification signal, the crank angle reference signal having high and low levels which change at a first reference crank position and at a second reference crank position of each cylinder of the engine, the cylinder identification signal corresponding to a first group of cylinders of the engine, the cylinder identification signal being out of phase with respect to the crank angle reference signal;

a second step of detecting the level of the cylinder identification signal at the time when the level of the crank angle reference signal changes;

a third step of determining whether the detected level of the cylinder identification signal is high or low;

a fourth step of determining whether the value of a first counter for the first group of cylinders is equal to a first predetermined number, if the detected level of the cylinder identification signal is high;

a fifth step of performing ignition control for the first group of cylinders if the value of the first counter is equal to the first predetermined number;

a sixth step of skipping ignition control for the first group of cylinders if the first counter is not equal to the first predetermined value;

a seventh step of setting the first counter to a second predetermined value after the sixth or seventh step;

an eighth step of changing the value of a second counter for the other second group of cylinders of the engine after the seventh step;

a ninth step of determining whether the value of the second counter is equal to the first predetermined number, if the detected level of the cylinder identification signal is low;

a tenth step of performing ignition control for the second group of cylinders if the value of the second counter is equal to the first predetermined number;

an eleventh step of skipping ignition control for the second group of cylinders if the second counter is not equal to the first predetermined value;

a twelfth step of setting the second counter to the second predetermined value after the eleventh step;

a thirteenth step of changing the value of the first counter after the twelfth step; and repeating all the above steps.

4. An ignition control method according to claim 3, wherein the eighth step of changing the value of the second counter comprises decrementing the second counter by "1".

5. An ignition control method according to claim 3, wherein the thirteenth step of changing the value of the first counter comprises decrementing the first counter by "1".

* * * * *